US007311340B2

(12) United States Patent
Baillet

(10) Patent No.: US 7,311,340 B2
(45) Date of Patent: Dec. 25, 2007

(54) LOCK FOR MOTOR VEHICLE OPENING COMPRISING MEANS FOR INSIDE AND OUTSIDE LOCKING

(75) Inventor: Dominique Baillet, Barlin (FR)

(73) Assignee: Valeo Securite Habitacle, Creteil (FR)

( * ) Notice: Subject to any disclaimer, the term of this patent is extended or adjusted under 35 U.S.C. 154(b) by 66 days.

(21) Appl. No.: 10/516,615

(22) PCT Filed: May 27, 2003

(86) PCT No.: PCT/EP03/50198

§ 371 (c)(1),
(2), (4) Date: Dec. 3, 2004

(87) PCT Pub. No.: WO03/106792

PCT Pub. Date: Dec. 24, 2003

(65) Prior Publication Data

US 2005/0156435 A1 Jul. 21, 2005

(30) Foreign Application Priority Data

Jun. 13, 2002 (FR) ..... 02 07250

(51) Int. Cl.
*E05C 3/06* (2006.01)
*E05C 3/16* (2006.01)

(52) U.S. Cl. ..... 292/216; 292/201; 292/336.3; 292/DIG. 23

(58) Field of Classification Search ..... 292/216, 292/201, 336.3, DIG. 23
See application file for complete search history.

(56) References Cited

U.S. PATENT DOCUMENTS

| | | | | |
|---|---|---|---|---|
| 2,782,062 | A * | 2/1957 | Smith | 292/216 |
| 3,525,545 | A * | 8/1970 | Leslie | 292/216 |
| 3,583,742 | A * | 6/1971 | Kwasiborski, Jr. | 292/216 |
| 3,781,045 | A * | 12/1973 | Watermann | 292/216 |
| 3,840,258 | A * | 10/1974 | Brackmann | 292/216 |
| 5,253,906 | A * | 10/1993 | Rogers et al. | 292/216 |
| 5,722,272 | A | 3/1998 | Bridgeman et al. | |
| 6,109,079 | A | 8/2000 | Ikeda | |
| 6,135,513 | A * | 10/2000 | Hamada et al. | 292/201 |
| 6,264,257 | B1 * | 7/2001 | Meinke | 292/336.3 |

FOREIGN PATENT DOCUMENTS

| | | |
|---|---|---|
| DE | 44 42 459 A1 | 6/1995 |
| EP | 0 722 029 A2 | 7/1996 |
| EP | 0 775 791 A1 | 5/1997 |

* cited by examiner

*Primary Examiner*—Carlos Lugo
(74) *Attorney, Agent, or Firm*—Berenato, White & Stavish

(57) ABSTRACT

A lock (10) for a motor vehicle opening including an external and internal control mechanism which can be inhibited by respectively locking an input lever and an output lever. A linking mechanism is arranged between the input lever and the output lever to link the two levers in angular displacement.

17 Claims, 3 Drawing Sheets

LOCK FOR MOTOR VEHICLE OPENING COMPRISING MEANS FOR INSIDE AND OUTSIDE LOCKING

The invention relates to a lock for an opening leaf of a motor vehicle.

The invention relates more specifically to a lock for an opening leaf of a motor vehicle, of the type comprising:

- operating means for opening from the outside and operating means for opening from the inside,
- a primary lever which is mounted so that it can pivot about a fixed primary pin, between an angular unlocking position and an angular locking position, in order to inhibit the means for operating from the outside,
- a secondary lever which is mounted so that it can pivot about a fixed secondary pin, substantially parallel to the primary pin, between an angular unlocking position and an angular locking position, in order to inhibit the means for operating from the inside,
- a driving member which is connected to the primary lever in order to directly pivot the primary lever, from its locking position toward its unlocking position, during an operating phase referred to as outside unlocking phase.

The invention relates more specifically to a lock for a side door of a motor vehicle.

Such a lock comprises, apart from a neutral unlocking function, a number of locking functions, namely outside locking which makes it possible to prevent opening of the lock solely from the outside of the vehicle, inside locking, or "child lock" function, which makes it possible to prevent opening of the lock solely from the inside of the vehicle, and the "superlocking" function which makes it possible to prevent opening of the lock both from the inside and from the outside.

The superlocking function makes it possible to prevent a thief from opening the lock, even when the window of the door has been broken.

It is known practice to use a lock comprising these various functions. These functions are generally implemented by means of electric actuators which drive the primary lever associated with the "locking" function and the secondary lever associated with the "superlocking" function, these actuators being operated by means of a remote control.

When the means for operating the lock are inhibited from the inside and from the outside, that is to say when the lock is "superlocked", an electrical fault makes it impossible to open the lock.

The fact that the lock is prevented from being opened from the outside causes an inconvenience for the user but does not present any danger for him.

By contrast, the fact that the lock is prevented from being opened from the inside presents a considerable risk for the safety of the user, since the user must always be able to exit his vehicle, particularly in the event of an accident.

When the locking and unlocking linkages are independent, for example in the case of a lock without an actuating member such as a "lock stalk", the lock is opened by means of a key which interacts with a cylinder mechanically operating a lever driving the primary lever in the direction of its unlocking. However, the kinematic linkage of the secondary lever remains in a locked state.

In this situation, the user can gain entry to the inside of the vehicle, since the operating means for opening from the outside are released, but he cannot exit the vehicle since the operating means for opening from the inside are still inhibited.

The same situation arises when only the electric actuator of the secondary lever is defective, for example as a result of the supply wire having broken or because of a fault with the electronic unit, and when the electric actuator of the primary lever is operational.

For this reason it is necessary to provide safety control means which make it possible for unlocking of the secondary lever to be effected on each occasion that the primary lever is unlocked. These safety means must be used, on the one hand, when the primary lever is unlocked mechanically, in particular by means of the cylinder, and, on the other hand, when the primary lever is unlocked electrically by means of its electric actuator.

The invention aims to provide a simple, effective and economic solution to solve this problem.

To this end, the invention provides a lock of the type which is described above, characterized in that a connection means is arranged between the primary lever and the secondary lever so as to link the angular displacement of the two levers during an outside unlocking phase, with the aim of bringing about global unlocking of the lock consisting in pivoting the two levers from their respective locking positions toward their respective unlocking positions.

Thus, when only the electric actuator of the secondary lever is defective, or in the case of mechanical opening via the cylinder, the primary lever compensates for this fault by driving the secondary lever.

Advantageously, the connection means is a link rod which comprises a point of articulation on the primary lever and a point of articulation on the secondary lever.

Another aim of the present invention is to ensure that, in all cases, the user is able to exit his vehicle.

To this end, the present invention proposes selecting the position of the articulation points of the link rod so that, during the global unlocking phase, the secondary lever reaches its unlocking position before the primary lever reaches its unlocking position.

It is therefore not possible for the user to remain trapped in his vehicle.

According to another advantageous feature of the invention:

- the link rod is articulated at a fixed point of the primary lever,
- the link rod is articulated on the secondary lever by means of an axial peg which is borne by the link rod and which interacts with an edge of a slot made in the secondary lever, so that the link rod links the angular displacement of the two levers only during the global unlocking phase.

By virtue of this feature, when the secondary lever occupies its unlocking position, the primary lever is free to pivot between its angular unlocking position and its angular locking position, without driving the secondary lever.

Moreover, as the connection between the two levers is rigid, in the direction of their unlocking, when one of the levers comes up against its stop, that prevents the other lever from pivoting.

The manufacturing tolerances and the spread in the assembly of the various elements of the lock do not always make it possible to ensure that, when one of the levers is against its stop, and therefore unlocked, the other lever is itself also unlocked.

The invention proposes solving this problem by providing a lock which is characterized in that the edge of the slot is a cam which is configured so that, during the global unlocking phase, the radial distance between the peg and the secondary pin increases, with the aim of allowing the primary lever to continue its pivoting motion as far as its unlocking position, after the secondary lever has reached its unlocking position.

According to other features of the invention:

- the cam comprises a final portion relative to the global unlocking phase, which describes a defined angle with respect to the direction of displacement of the link rod, depending on the angular position of the secondary lever during the global unlocking phase, and in that said angle is:
- greater than or equal to ninety degrees, at the start of the global unlocking phase, when the secondary lever occupies its locking position,
- less than ninety degrees, during the final step of the global unlocking phase, when the secondary lever wholly occupies its unlocking position and the primary lever does not yet occupy its locking position, so that, during the final step of the global unlocking phase, the peg is displaced wholly radially outward with respect to the secondary pin, remaining in circumferential contact with the final portion of the cam, in the direction of unlocking of the secondary lever;
- the final portion of the cam is substantially rectilinear and parallel to a radial direction of the secondary pin, so that, during the final step of the global unlocking phase, the peg is displaced in said radial direction with respect to the secondary pin;
- the cam wholly forms a V, and in that, when the two levers occupy their respective locking positions, the peg bears in the angle of the V formed by the cam;
- when the two levers occupy their respective unlocking positions, the peg is housed in the slot with a radial clearance, on the side directed away from the secondary pin;
- each lever comprises two opposed circumferential stops which wholly determine the associated angular locking and unlocking positions;
- the lock comprises means designed to make the secondary lever bistable.

Other features and advantages of the invention will become apparent on reading the detailed description which follows, a clearer understanding of which will be gained by referring to the attached figures, in which.

In the description which will follow, similar or identical elements will bear the same references.

Figure 1:
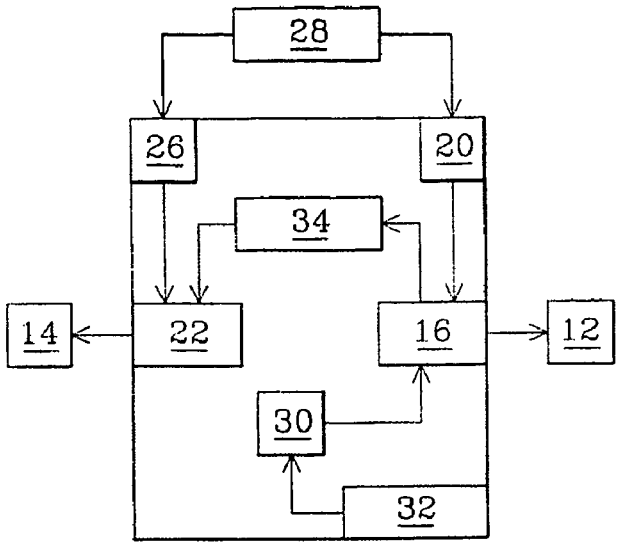
FIG. 1 is a diagram which represents a lock produced according to a first embodiment of the invention.

FIG. 1 schematically represents a lock 10 which is, for example, intended to be fixed to a door (not shown) of a motor vehicle and which is produced according to the teachings of the invention, according to a first embodiment.

The lock 10 comprises, for example, a fixed frame (not shown) on which are mounted the main elements constituting the locking mechanism of the lock 10.

The main elements of the locking mechanism are schematically illustrated in FIG. 1.

The lock 10 comprises operating means for opening from the outside, for example in the form of an outer paddle handle 12, which are arranged in the outer wall of the vehicle door.

The lock 10 comprises operating means for opening from the inside, for example in the form of an inner paddle handle 14, which are arranged in the inner wall of the vehicle door.

The lock 10 comprises means for inhibiting the outer paddle handle 12, so as to prevent the lock 10 from being opened from the outside of the vehicle. These means therefore implement the outside locking function of the vehicle.

The means for locking the outer paddle handle are represented here by a primary lever 16.

Figure 2:
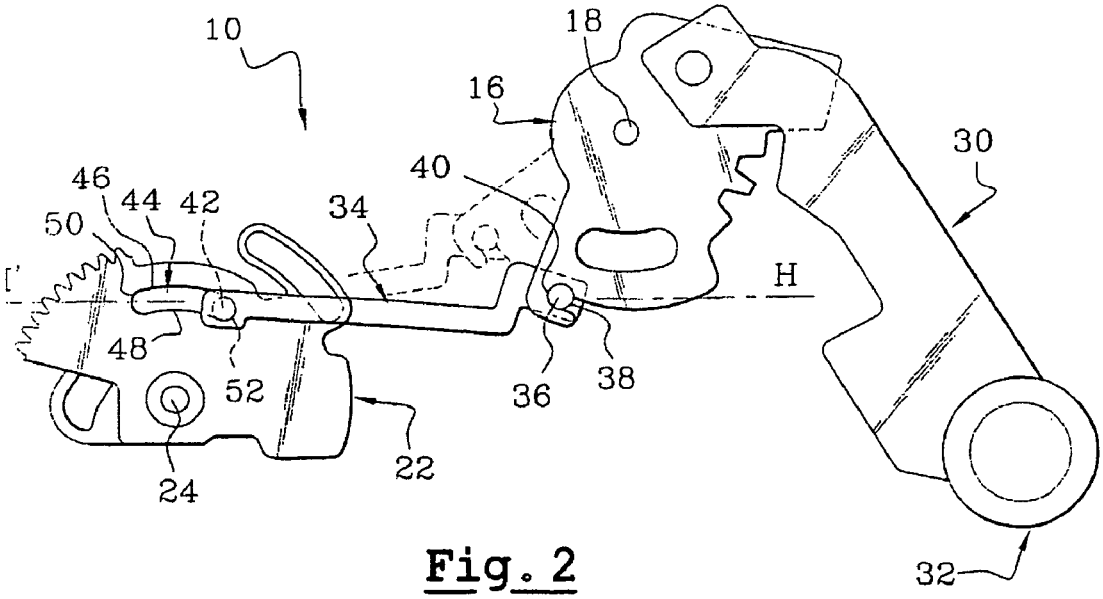
FIG. 2 is a side view which schematically represents the main elements of the device for locking the lock of FIG. 1, when the primary lever and the secondary lever are unlocked.

According to the embodiment represented in FIG. 2, the primary lever 16 is pivotally mounted on the frame, about a fixed primary pin 18, between an angular unlocking position, represented in a solid line, and an angular locking position, represented in a broken line. In its locking position, the primary lever 16 inhibits the outer paddle handle 12.

The angular unlocking position and the angular locking position are respectively determined by stop means (not shown).

These stop means consist, for example, of an unlocking stud and of a locking stud which interact with a complementary bearing surface borne by the primary lever 16.

The primary lever 16 is able to be rotated about its pin 18 by an associated primary electric actuator 20.

The lock 10 comprises means for inhibiting the inner paddle handle 14 so as to prevent the lock 10 from being opened from the inside of the vehicle. These means therefore implement the inside locking function of the vehicle.

The "superlocking" function, which will be referred to here as "global locking", is implemented by inhibiting both the inner paddle handle 14 and the outer paddle handle 12.

The means for locking the inner paddle handle are represented hereby a secondary lever 22.

Figure 5:
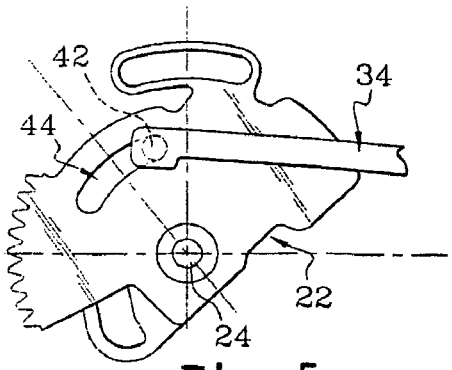
FIG. 5 is a view similar to that of FIG. 3 which represents the secondary lever in the locking position.

According to the embodiment represented in FIG. 2, the secondary lever 22 is pivotally mounted on the frame, about a fixed secondary pin 24, which is substantially parallel to the primary pin 18, between an angular unlocking position, represented particularly in FIG. 2, and an angular locking position, represented particularly in FIG. 5. In its locking position, the secondary lever 22 inhibits the inner paddle handle 14.

The angular unlocking position and the angular locking position are respectively determined by stop means (not shown).

These stop means consist, for example, of an unlocking stud and of a locking stud which interact with a complementary bearing surface borne by the secondary lever 22.

Advantageously, the lock 10 comprises means designed to make the secondary lever 22 bistable, for example an elastic tongue which is produced in one piece with the secondary lever 22 and which is designed to interact with a boss borne by the frame, with the aim of causing the secondary lever 22 to be tilted toward its angular stop positions.

The secondary lever 22 is able to be rotated about its pin 24 by an associated secondary electric actuator 26.

The electric actuators 20, 26 are operated for example by means of a remote control 28.

The lock 10 also comprises a mechanical driving member which is connected to the primary lever 16 in order to cause it to pivot directly. This driving member here consists of a transfer lever 30 which is operated by a cylinder 32.

The pivoting of the cylinder 32, which is produced for example by means of a key (not shown), actuates the transfer lever 30 which mechanically drives the primary lever 16 about its primary pin 18.

According to the teachings of the invention, the lock 10 comprises a link rod 34 which is arranged between the primary lever 16 and the secondary lever 22.

The link rod 34 is articulated at a fixed point 36 of the primary lever 16, in this case by its first longitudinal end, which comprises a finger 38 fitted into a housing 40 of the primary lever 16 and forming an articulation about an axis parallel to the primary pin 18.

The link rod 34 comprises, at its second longitudinal end, an axial peg 42 which is housed axially in a slot 44 made in the secondary lever 22.

In the remainder of the description, use will be made, by way of non-limiting illustration, of a left-to-right orientation in a horizontal direction H'H substantially orthogonal to the pins 18, 24 of the levers 16, 22.

With the aim of making it easier to understand the way in which the lock 10 operates, it will be considered here that the rotation of the primary lever 16 causes a substantially horizontal displacement of the link rod 34 in the direction H'H.

With regard to the rotational movements, a clockwise direction and counterclockwise direction will be defined arbitrarily with consideration to FIG. 2.

The slot 44 extends wholly in a plane transverse to the secondary pin 24, and it here has the form of an arc of a circle centered on the secondary pin 24. The slot 44 here extends over an angular portion situated above a horizontal axial plane, with consideration to FIG. 2, when the secondary lever 22 occupies its unlocking position.

The slot 44 comprises an upper edge 46 and a lower edge 48 in the form of arcs of a circle, and also a left-hand circumferential end edge 50 and a right-hand circumferential end edge 52 of rounded shape, which will be referred to respectively as left-hand edge 50 and right-hand edge 52.

The peg 42 is able to occupy two end positions, in the slot 44, which are delimited by the two circumferential end edges 50, 52 of the slot 44.

The link rod 34 makes it possible to link the angular displacement of the primary lever 16 and secondary lever 22 during an operating phase which will be referred to as "global unlocking phase", which consists in pivoting the primary lever 16 and the secondary lever 22 from their respective locking positions toward their respective unlocking positions.

Thus, it can be said that the transfer lever 30 is linked directly to the primary lever 16, and it is linked indirectly to the secondary lever 22 via the link rod 34.

The normal operation of the lock 10, that is to say in the absence of failure, is as follows.

Figure 3:
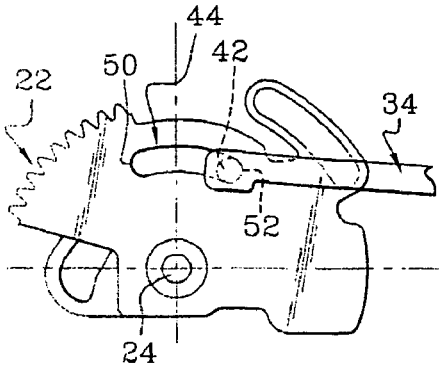
FIG. 3 is a side view which schematically represents the secondary lever and the link rod of the lock of FIG. 2 in the unlocking position, when the primary lever is in the unlocking position.

The initial positions which will be selected arbitrarily for the primary lever 16 and the secondary lever 22 are their unlocking positions as represented in FIGS. 2 and 3.

When the primary lever 16 and secondary lever 22 occupy their unlocking positions, the link rod 34 is shifted as far as possible toward the right, such that the axial peg 42 is situated in the vicinity of the right-hand edge 52 of the slot 44.

The user, who wishes to lock the outer paddle handle 12, electrically operates the primary electrical actuator 20, for example by means of the remote control 28, in order to cause the primary lever 16 to pivot from its unlocking position toward its locking position, in this case in the clockwise direction.

During the pivoting of the primary lever 16 toward its locking position, the link rod 34 is displaced with the primary lever 16 toward the left, such that the axial peg 42 is also displaced toward the left, guided by the slot 44 in the secondary lever 22 which remains fixed.

The axial peg 42 tends to be placed in that part of the slot 44 at the extreme left, since the articulation 36 of the link rod 34 is displaced wholly toward the left.

Figure 4:
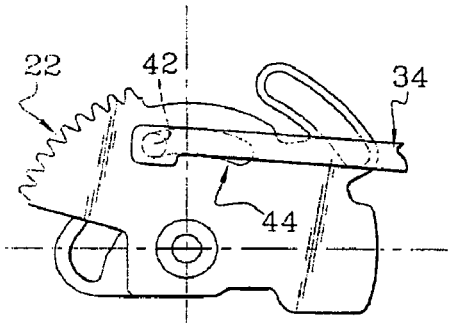
FIG. 4 is a view similar to that of FIG. 3 which represents the secondary lever in the unlocking position, when the primary lever is in the locking position.

The axial peg 42 then occupies a left-hand end position, in the vicinity of the left-hand edge 50 of the slot 44, as represented in FIG. 4.

The primary lever 16 then bears against its locking stop and the outer paddle handle 12 is inhibited.

In the situation of outside locking, the user can initiate global locking by operating the secondary actuator 26 so that it causes the secondary lever 22 to pivot, in this case in the counterclockwise direction, as far as its locking position.

This pivoting of the secondary lever 22 creates a relative movement of the slot 44 with respect to the axial peg 42, such that the axial peg 42 occupies a right-hand end position in the slot 44, in the vicinity of the right-hand edge 52, as represented in FIG. 5.

It will be noted that, when the secondary lever 22 is in the locking position, the primary lever 16 is unable to pivot as far as its unlocking position, since the axial peg 42 bears substantially against the right-hand edge 52 of the slot 44, preventing the link rod 34 from being displaced toward the right.

Consequently, in order to be able to unlock the outer paddle handle 12 by unlocking the primary lever 16, it is necessary to unlock, beforehand or simultaneously, the inner paddle handle 14 by unlocking the secondary lever 22.

To this end, when the user initiates global unlocking of the lock 10, the secondary actuator 26 is operated, so that it causes the secondary lever 22 to pivot in the clockwise direction, in order to unlock it, and the primary actuator 20 is operated, simultaneously or after the secondary actuator 26, so that it causes the primary lever 16 to pivot in the counterclockwise direction, in order to unlock it.

For the safety of the users of the vehicle, it is important to provide for the case of a failure of the electrical control means for the primary lever 16 and secondary lever 22, in the global locking situation.

In this situation, the user acts on the cylinder 32 by means of a key so as to cause the transfer lever 30 to pivot.

While pivoting, the transfer lever 30 causes direct rotation of the primary lever 16, in the counter-clockwise direction, from its locking position toward its unlocking position.

At the same time as the pivoting of the primary lever 16, the transfer lever 30 causes indirect pivoting of the secondary lever 22, via the link rod 34, in the clockwise direction, from its locking position toward its unlocking position. What happens is that, during the pivoting of the primary lever 16, the link rod 34 is displaced toward the right and it presses against the right-hand edge 52 of the slot 44, which causes the secondary lever 22 to rotate about its secondary pin 24.

When only the control means for the secondary lever 22 experience an electrical failure, then, during the global unlocking phase, the primary actuator 20 drives the primary lever 16 directly and the secondary lever 22 indirectly, via the link rod 34, in an operation similar to that described above.

Problems may arise with the lock 10 according to the first embodiment of the invention.

A first problem is the position occupied by the primary lever 16 and secondary lever 22 with respect to their respective angular stops, depending on the various operating situations.

To obtain correct operation of the lock 10, it is necessary for the primary lever 16 and secondary lever 22 to each have its own angular stops.

During global unlocking, the pivoting of the primary lever 16 is linked to the pivoting of the secondary lever 22 via the link rod 34. Consequently, when one of the two levers 16, 22 reaches its unlocking stop, for example the primary lever 16, then the secondary lever 22 is no longer being caused to rotate.

It is important for the secondary lever 22 to occupy its unlocking position when it is no longer being rotated. However, taking particular account of the manufacturing and assembly tolerances of the lock 10, it is not guaranteed that the secondary lever 22 has reached its unlocking position when it is no longer being rotated.

The consequence of this malfunctioning is that the outer paddle handle 12 may be released while the inner paddle handle 14 is still inhibited. A user may thus enter the vehicle by opening the door from the outside, but he will be unable to get out of it again.

It is thus required to guarantee that the two levers 16, 22 can pivot as far as their angular stops, and it is required to ensure that the secondary lever 22 is unlocked before the primary lever 16, so that the inner paddle handle 14 is released before the outer paddle handle 12.

Furthermore, if one of the levers 16, 22 occupies an intermediate position between its angular stop positions, it may interfere with the movement of certain parts of the mechanisms of the lock 10, in particular the parts which are set in motion during an operating phase known as "override", which aims to bring about unlocking of the primary lever 16, in the situation of outside locking, when a user manipulates the inner paddle handle 14.

The lock 10 which is produced according to the second embodiment of the invention solves these problems.

The lock 10 according to the secondary embodiment of the invention solves these problems simply by modifying the slot 44 made in the secondary lever 22, without it being necessary to modify the other parts of the lock 10.

Consequently, FIGS. 9 to 14 represent only the secondary lever 22, according to the second embodiment of the invention, in various angular positions, with regard to FIGS. 3 to 8 which represent the secondary lever 22 according to the first embodiment of the invention in the corresponding angular positions.

A description will now be given of the second embodiment of the invention, emphasizing the differences in structure and operation over the lock 10 according to the first embodiment of the invention.

The form of the slot 44 when the secondary lever 22 occupies its unlocking position, which is represented particularly in FIG. 9, will be described.

According to the teachings of the invention, the leverage of the point of articulation of the link rod 34 on the secondary lever 22, that is to say the distance between the axial peg 42 and the secondary pin 24, is selected so that the secondary lever 22 reaches its unlocking position before the primary lever 16 reaches its own unlocking position.

Furthermore, the edge 54 of the slot 44 on which the axial peg 42 bears during the global unlocking phase is a cam which is configured so that the radial distance R between the peg 42 and the secondary pin 24 increases, with the aim of allowing the primary lever 16 to continue its pivoting motion as far as its unlocking position, after the secondary lever 22 has reached its unlocking position.

Figure 9:
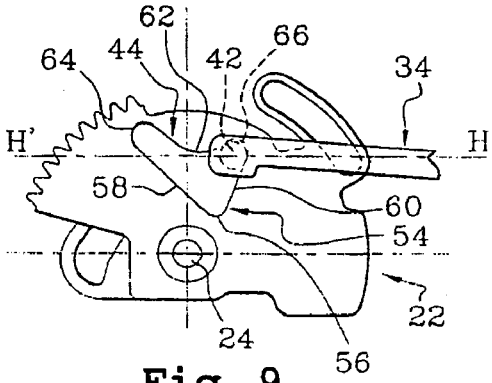
FIGS. 9 to 12 are views similar to that of FIG. 3 which represent a secondary lever produced according to a second embodiment of the invention when it occupies various angular positions respectively corresponding to the angular positions represented in FIGS. 3 to 8.

The slot 44 here has the shape of a "V" and it extends over an angular portion situated above a horizontal axial plane, with consideration to FIG. 9.

The "V" shape of the slot 44 is delimited mainly by the cam 54.

The angle of the V formed by the cam 54 is acute here, and the notch 56 formed by the intersection of the two branches of the V wholly corresponds to that portion of the slot 44 which is closest to the secondary pin 24.

The notch 56 is here offset toward the right and upwardly with respect to the secondary pin 24.

The cam 54 comprises a left-hand portion 58 which extends from the notch 56 toward the left, here describing an angle of about forty-five degrees with respect to the horizontal direction H'H.

The cam 54 comprises a right-hand portion 60 which extends from the notch 56 toward the right, here describing an angle of about sixty degrees with respect to the horizontal direction H'H.

The right-hand portion 60 here extends in a direction parallel to a radial direction of the secondary pin 24.

The right-hand portion 60 here is substantially shorter than the left-hand portion 58.

The upper edge 62 of the slot 44 wholly forms a boss which is downwardly convex.

The slot 44 thus comprises three ends which correspond to three notable points of the cam 54, that is to say the left-hand end 64 of the left-hand portion 58, the notch 56, and the right-hand end 66 of the right-hand portion 60.

The normal operation of the lock 10 according to the second embodiment, in the absence of electrical failure, is wholly the same as that of the lock 10 according to the first embodiment.

When the primary lever 16 and the secondary lever 22 occupy their respective unlocking positions, as has been represented in FIG. 9, the axial peg 42 occupies, in the slot 44, a first position P1 in the vicinity of the right-hand end 66 of the right-hand portion 60.

Figure 10:
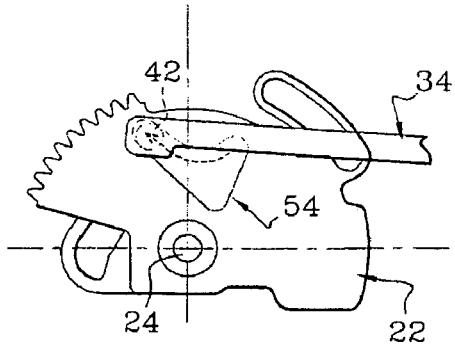

When the primary lever 16 is made to pivot toward its locking position, the link rod 34 is wholly displaced toward the left, such that the axial peg 42 occupies a second position P2 in the vicinity of the left-hand end 64 of the left-hand portion 58, as represented in FIG. 10.

While being displaced toward the left, the axial peg 42 is guided toward its second position P2 by the upper edge 62 of the slot 44 and by the cam 54.

Figure 11:
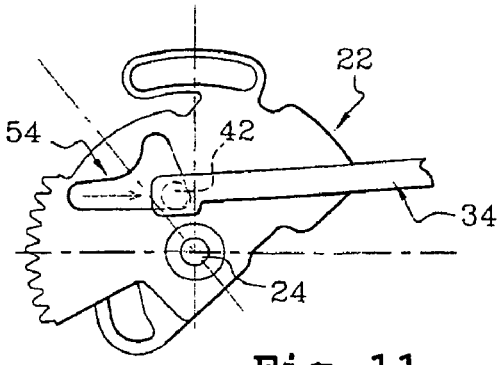

When the secondary lever 22 is made to pivot toward its locking position, in the counterclockwise direction, the slot 44 pivots with respect to the axial peg 42 such that the latter occupies a third position P3, bearing in the notch 56, as represented in FIG. 11.

During the pivoting of the slot 44 about the secondary pin 24, the axial peg 42 is guided by the left-hand portion 58 of the cam 54 toward the notch 56.

Figure 12:
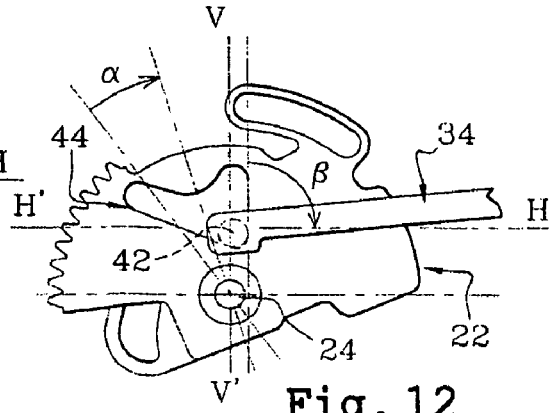
Figure 7:
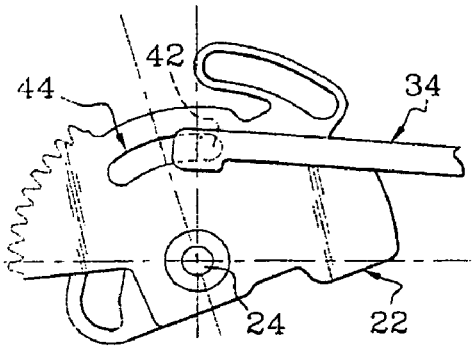
FIG. 7 is a view similar to that of FIG. 3 which represents the secondary lever in a second intermediate position during the global unlocking phase.
Figure 13:
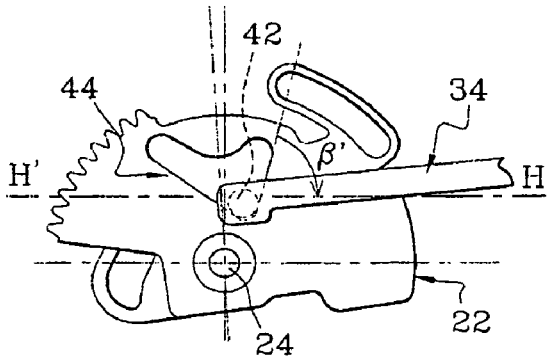
Figure 8:
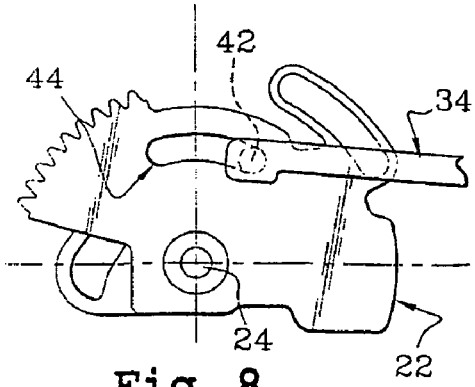
FIG. 8 is a view similar to that of FIG. 3 which represents the secondary lever at the end of the global unlocking phase, in its unlocking position.
Figure 14:
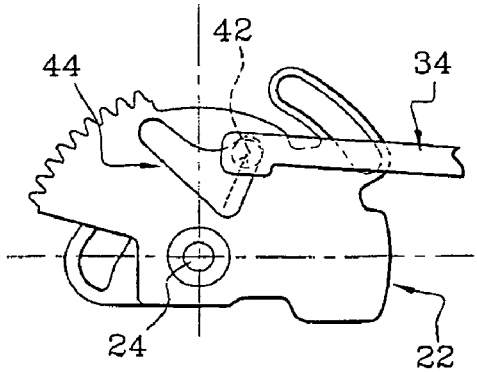

FIGS. 12 to 14 illustrate the various angular positions occupied by the secondary lever 22, depending on the position of the link rod 34 and of the axial peg 42 in the slot 44, during the global unlocking phase implemented following an electrical failure.

During a first operating step, which is delimited by the angular positions represented in FIGS. 11 and 12, the link rod 34 is displaced toward the right, since the primary lever 16 is pivoted toward its unlocking position, for example by means of the cylinder 32.

During this first step, the displacement of the link rod 34 and of the associated axial peg 42, which bears in the notch 56, causes the secondary lever 22 to pivot in the clockwise direction until the right-hand portion 60 of the cam 54 is substantially vertical, as represented in FIG. 12.

It will be noted that, when the axial peg 42 occupies its third position P3, in the notch 56, the radial distance R3 which separates it from the secondary pin 24 is less than the radial distance R1 which separates it from the secondary pin 24 when it occupies its first position P1 or its second position P2 in the slot 44.

Figure 6:
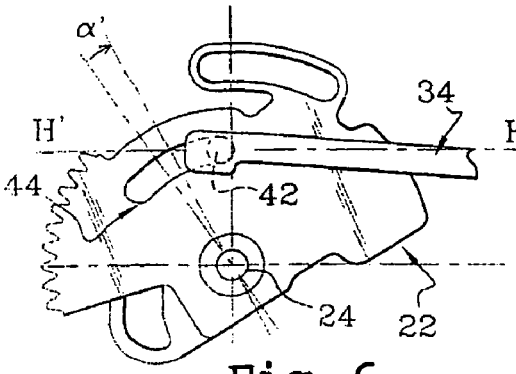
FIG. 6 is a view similar to that of FIG. 3 which represents the secondary lever in a first intermediate position during a global unlocking phase.

Comparing FIGS. 5 and 6, which represent the secondary lever 22 according to the first embodiment, with FIGS. 11 and 12, which represent the secondary lever 22 according to the second embodiment, at the same stages of the movement of the link rod 34, it will be noted that the radial distance R3 which separates the axial peg 42 from the secondary pin 24 is shorter for the secondary lever 22 according to the second embodiment, with the result that the crank throw is smaller, which leads to a greater rotational speed of the secondary lever 22 for an identical displacement of the link rod 34.

Owing to the small radial distance R3 between the axial peg 42 and the secondary pin 24 in the second embodiment, for the same displacement of the link rod 34 toward the right, that is to say for the same angular displacement of the primary lever 16, the angular displacement of the secondary lever 22 according to the second embodiment is greater than the angular displacement of the secondary lever 22 according to the first embodiment.

Specifically, it will be noted in FIGS. 6 and 12 that the link rod 34 has covered substantially the same distance toward the right in both cases, but the pivoting angle $\alpha$ of the secondary lever 22 according to the second embodiment (FIG. 12), with respect to its locking position, is greater than the corresponding pivoting angle $\alpha'$ of the secondary lever 22 according to the first embodiment (FIG. 6).

In FIG. 13, the secondary lever 22 practically occupies its unlocking position, and it is considered that it has already caused the inner paddle handle 14 to be released.

In this position, the right-hand portion 60 of the cam 54 is inclined toward the right with respect to the vertical direction V'V which passes through the secondary pin 24. This inclination makes it possible for the axial peg 42 to slide along the right-hand portion 60 of the cam 54 during a second step, or final step, being displaced toward the right with the link rod 34 and being displaced radially outward while remaining in contact with the cam 54 so as to keep the secondary lever 22 in its unlocking position.

In this way the link rod 34 can continue its displacement toward the right, the peg 42 being displaced upward and toward the right in the slot 44 until the primary lever 16 reaches its unlocking position. The final position of the axial peg 42 thus corresponds to the first position P1, in the vicinity of the right-hand end 66 of the right-hand portion 60, as represented in FIG. 14.

The angle $\beta$ formed by the right-hand portion 60 of the cam 54 with the substantially horizontal direction H'H of displacement of the link rod 34, according to the angular position of the secondary lever 22, is decisive for ensuring that the secondary lever 22 is caused to rotate by the link rod 34.

Specifically, as soon as the angle $\beta$ is greater than ninety degrees, the axial peg 42 is retained radially in the notch 56, and any displacement of the link rod 34 toward the right is converted into an angular displacement of the secondary lever 22 in the clockwise direction.

The secondary lever 22 thus passes as far as the angular position which is represented in FIG. 12, in which the angle $\beta$ is substantially equal to ninety degrees.

From this angular position, the axial peg 42 is no longer retained radially in the notch 56, with the result that it is able to be displaced radially outward.

On account of the frictional forces of the axial peg 42 against the cam 54, which tend to retain the peg 42 in its initial position, in the notch 56, the outward radial displacement of the peg 42 occurs only from a defined angle $\beta'$, which is less than ninety degrees. To obtain such an angle $\beta'$, the slope of the right-hand portion 60 of the cam 54 is inclined toward the right and upward, as represented in FIG. 13.

The cam 54 is configured so that, when the right-hand portion 60 describes its angle $\beta'$ with the direction H'H of the displacement of the link rod 34, that is to say at the end of the first step, the secondary lever 22 wholly occupies its unlocking position, as represented in FIG. 13.

It will thus be noted that, during the pivoting of the secondary lever 22 toward its unlocking position, the radial distance between the axial peg 42 and the secondary pin 24 increases. The corresponding radial displacement of the axial peg 42 is possible by virtue of the slope of the right-hand portion 60 of the cam 54, which is inclined upwardly and toward the right, that is to say wholly in the direction of the displacement of the link rod 34.

The lock 10 according to the second embodiment of the invention thus makes it possible to accelerate the angular pivoting of the secondary lever 22 with respect to the angular pivoting of the primary lever 16 during the first step, which guarantees the unlocking of the secondary lever 22 before that of the primary lever 16. This "acceleration" is achieved without modifying the value of the angular travel of the secondary lever 22 between its two stops.

Advantageously, the acceleration of the angular pivoting of the secondary lever 22 with respect to the angular pivoting of the primary lever 16 is obtained here by selecting the position of the points 36, 42 of articulation of the link rod 34 on the primary lever 16 and secondary lever 22. More precisely, insofar as the link rod 34 here is displaced substantially longitudinally in the direction H'H, a radial distance R between the peg 42 and the secondary pin 24 is selected which is shorter than the radial distance between the fixed articulation point 36 and the primary pin 18, so that the crank arm is shorter on the secondary lever 22 than on the primary lever 16, which allows the secondary lever 22 to reach its unlocking position before the primary lever 16.

When the secondary lever 22 bears against its unlocking stop, it must not prevent the primary lever 16 from continuing its pivoting motion as far as its own unlocking stop. That is why a radial clearance is provided between the right-hand end 66 of the right-hand portion 60 of the cam 54 and the axial peg 42 when the primary lever 16 occupies its unlocking position.

Similarly, a clearance is provided between the end 64 of the left-hand portion 58 of the cam 54 and the axial peg 42 when the primary lever 16 occupies its locking position, the secondary lever 22 occupying its unlocking position (FIG. 10).

The lock 10 according to the second embodiment of the invention makes it possible to guarantee that the primary lever 16 and the secondary lever 22 bear against their respective angular stops when they occupy their respective locking or unlocking positions.

It will be noted that the boss 62 in the slot 44 assists in preventing the peg 42 from retreating axially from the slot 44, in particular during the pivoting of the primary lever 16 toward its locking position, the peg 42 being displaced toward the left from its first position P1 toward its second position P2.

The invention claimed is:

1. A lock for an opening leaf of a motor vehicle comprising:

operating means for opening from the outside of the motor vehicle and operating means for opening from the inside of the motor vehicle, a primary lever which is mounted so that it can pivot about a fixed primary pin, between an angular unlocking position and an angular locking position, in order to inhibit the means for operating from the outside, a secondary lever which is mounted so that it can pivot about a fixed secondary pin, substantially parallel to the primary pin, between an angular unlocking position and an angular locking position, in order to inhibit the means for operating from the inside, a driving member which is connected to the primary lever in order to directly pivot the primary lever, from its locking position toward its unlocking position, during an operating phase referred to an outside unlocking phase, wherein a connection means is arranged between the primary lever and the secondary lever so as to link the angular displacement of the two levers during outside unlocking phase, with the aim of bringing about global unlocking of the lock by pivoting the two levers from their respective locking positions toward their respective unlocking positions;

wherein the connection means is a link rod which comprises a point of articulation on the primary lever and a point of articulation on the secondary lever whereby the position of the articulation points of the link rod is selected so that, during the global unlocking phase, the secondary lever reaches its unlocking position before the primary lever reaches its unlocking position.

2. The lock as claimed in claim 1, wherein said lock comprises means designed to make the secondary lever bistable.

3. The lock according to claim 1, wherein said link rod is directly pivotally connected at a fixed location to said primary lever.

4. The lock according to claim 3, wherein said link rod is directly displaceably connected to said secondary lever.

5. The lock according to claim 1, wherein each of said primary and secondary levers further includes an associated remotely controlled electric actuator.

6. A lock for an opening leaf of a motor vehicle:

operating means for opening from the outside of the motor vehicle and operating means for opening from the inside of the vehicle, a primary lever which is mounted so that it can pivot about a fixed primary pin, between an angular unlocking position and an angular locking position, in order to inhibit the means for operating from the outside, a secondary lever which is mounted so that it can pivot about a fixed secondary pin, substantially parallel to the primary pin, between an angular unlocking position and an angular locking position, in order to inhibit the means for operating from the inside, a driving member which is connected to the primary lever in order to directly pivot the primary lever, from its locking position toward its unlocking position, during an operating phase referred to an outside unlocking phase, wherein a connection means is arranged between the primary lever and the secondary lever so as to link the angular displacement of the two levers during the outside unlocking phase, with the aim of bringing about global unlocking of the lock by pivoting the two levers from their respective locking positions toward their respective unlocking positions; the connection means is a link rod which comprises a point of articulation on the primary lever and a point of articulation on the secondary lever and the position of the articulation points of the link rod is selected so that, during the global unlocking phase, the secondary lever reaches its unlocking position before the primary lever reaches its unlocking position; and the link rod is articulated at a fixed point the primary lever, the link rod is articulated on the secondary lever by means of an axial peg which is borne by the link rod and which interacts with an edge of a slot made in the secondary lever, so that the link rod links the angular displacement of the two levers only during the global unlocking phase.

7. The lock as claimed in claim 6, wherein the edge of the slot is a cam which is configured so that, during the global unlocking phase, the radial distance (R) between the peg and the secondary pin increases, with the aim of allowing the primary lever to continue its pivoting motion as far as its unlocking position, after the secondary lever has reached its unlocking position.

8. The lock as claimed in claim 7, wherein the cam comprises a final portion relative to the global unlocking phase, which describes a defined angle (β, β') with respect to the direction (H'H) of displacement of the link rod depending on the angular position of the secondary lever during the global unlocking phase, and in that said angle (β, β') is:

greater than or equal to ninety degrees, at the start of the global unlocking phase, when the secondary lever occupies its locking position, less than ninety degrees, during the final step of the global unlocking phase, when the secondary lever wholly occupies its unlocking position and the primary lever does not yet occupy its locking position, so that, during the final step of the global unlocking phase, the peg is displaced wholly radially outward with respect to the secondary pin, remaining in circumferential contact with the final portion of the cam, in the direction of unlocking of the secondary lever.

9. The lock as claimed in claim 8, wherein the final portion of the cam is substantially rectilinear and parallel to a radial direction of the secondary pin, so that, during the final step of the global unlocking phase, the peg is displaced in said radial direction with respect to the secondary pin.

10. The lock as claimed in claim 7, wherein the cam wholly forms a V, and in that, when the two levers occupy their respective locking positions, the peg bears in the angle of the V formed by the cam.

11. The lock as claimed in claim 10, wherein each lever comprises two opposed circumferential stops which wholly determine the associated angular locking and unlocking positions.

12. The lock as claimed in claim 6, wherein, when the two levers occupy their respective unlocking positions, the peg is housed in the slot with a radial clearance, on the side directed away from the secondary pin.

13. A lock for an opening leaf of a motor vehicle comprising:

operating means for opening from the outside of the motor vehicle and operating means for opening from the inside of the motor vehicle, a primary lever which is mounted so that it can pivot about a fixed primary pin, between an angular unlocking position and an angular locking position, in order to inhibit the means for operating from the outside, a secondary lever which is mounted so that it can pivot about a fixed secondary pin, substantially parallel to the primary pin, between an angular unlocking position and an angular locking position, in order to inhibit the means for operating from the inside, a driving member which is connected to the primary lever in order to directly pivot the primary lever, from its locking position toward its unlocking position, during an operating phase referred to an outside unlocking phase, a connection means is arranged between the primary lever and the secondary lever so as to link the annular displacement of the two levers during outside unlocking phase, with the aim of bringing about global unlocking of the lock by pivoting the two levers from their respective locking positions toward their respective unlocking positions; wherein the connection means is a link rod which comprises a point of articulation on the primary lever and a point of articulation on the secondary lever whereby the position of the articulation points of the link rod is selected so that, during the global unlocking phase, the secondary lever reaches its unlocking position before the primary lever reaches its unlocking position; and wherein said driving member includes a transfer lever in turn driven by a key operated cylinder, whereby pivoting of said cylinder actuates transfer lever thereby mechanically driving said primary lever about said fixed primary pin.

14. The lock according to claim 13, wherein each of said primary and secondary levers further includes an associated remotely controlled electric actuator.

15. A lock for an opening leaf of a motor vehicle comprising:

operating means for opening from the outside of the motor vehicle and operating means for opening from the inside of the motor vehicle, a primary lever which is mounted so that it can pivot about a fixed primary pin, between an angular unlocking position and an angular locking position, in order to inhibit the means for operating from the outside, a secondary lever which is mounted so that it can pivot about a fixed secondary pin, substantially parallel to the primary pin, between an angular unlocking position and an angular locking position, in order to inhibit the means for operating from the inside, a driving member which is connected to the primary lever in order to directly pivot the primary lever, from its locking position toward its unlocking position, during an operating phase referred to an outside unlocking phase, a connection means is arranged between the primary lever and the secondary lever so as to link the angular displacement of the two levers during outside unlocking phase, with the aim of bringing about global unlocking of the lock by pivoting the two levers from their respective locking positions toward their respective unlocking positions; wherein the connection means is a link rod which comprises a point of articulation on the primary lever and a point of articulation on the secondary lever whereby the position of the articulation points of the link rod is selected so that, during the global unlocking phase, the secondary lever reaches its unlocking position before the primary lever reaches its unlocking position, said link rod is directly pivotally connected at a fixed location to said primary lever, said link rod is directly displaceably connected to said secondary lever; and wherein said driving member includes a transfer lever in turn driven by a key operated cylinder, whereby pivoting of said cylinder actuates transfer lever thereby mechanically driving said primary lever about said fixed primary pin.

16. The lock according to claim 15, wherein each of said primary and secondary levers further includes an associated remotely controlled electric actuator.

17. The lock according to claim 16, wherein each of said primary and secondary levers further includes an associated remotely controlled electric actuator.

* * * * *